US005750187A

United States Patent [19]

Magnone et al.

[11] Patent Number: 5,750,187

[45] Date of Patent: May 12, 1998

[54] PROCESS OF MANUFACTURING A CATHODE-RAY TUBE WITH AN ANTI-GLARE, ANTI-STATIC, DARK FACEPLATE COATING

[75] Inventors: Giuseppe Magnone, Alatri; Guido Manciocco, Colleferro; Patrizia Cinquina, Vasto, all of Italy

[73] Assignee: Videocolor, S.p.A., Anagni, Italy

[21] Appl. No.: 572,429

[22] Filed: Dec. 14, 1995

[30] Foreign Application Priority Data

Aug. 9, 1995 [IT] Italy ..... MI95A1768

[51] Int. Cl.[6] ..... B05D 5/12

[52] U.S. Cl. ..... 427/64; 427/68; 427/165; 427/108; 427/126.2; 427/126.3; 427/162

[58] Field of Search ..... 252/509, 513.2; 427/64, 68, 126.2, 126.3, 162, 165, 105, 108

[56] References Cited

U.S. PATENT DOCUMENTS 3,898,509 8/1975 Brown, Jr. et al. ..... 313/478

4,563,612 1/1986 Deal et al. ..... 313/478

4,694,218 9/1987 Chao ..... 427/160

5,346,721 9/1994 Tong ..... 427/167

*Primary Examiner*—Janyce Bell

*Attorney, Agent, or Firm*—Joseph S. Tripoli; Dennis H. Irlbeck; Vincent J. Coughlin, Jr.

[57] ABSTRACT

A process of manufacturing a cathode-ray tube (21) having a faceplate panel (27) with an exterior surface (39) having thereon an anti-glare, anti-static, dark coating (37) is described. The process is characterized by the steps of (a) forming a substantially homogeneous initial carbon dispersion containing substantially equal parts, by weight, of carbon particles and an organic vehicle; and (b) combining a sufficient quantity of the homogeneous initial carbon dispersion with an aqueous solution of lithium polysilicate to form a final dispersion suitable for application to the faceplate of the CRT.

7 Claims, 4 Drawing Sheets

SPECTRAL REFLECTANCE @ 70 GLOSS

ANTISTATIC PROPERTIES OF COATINGS

PROCESS OF MANUFACTURING A CATHODE-RAY TUBE WITH AN ANTI-GLARE, ANTI-STATIC, DARK FACEPLATE COATING

This invention relates to a process of manufacturing a cathode-ray tube (CRT) having an anti-glare, anti-static, dark coating on an external surface of a faceplate panel thereof, and more particularly, to the formulation of such a coating.

BACKGROUND OF THE INVENTION

For many applications it is desirable to have an effective faceplate transmission of about 40% to enhance the contrast of an image displayed on the tube and also to provide an anti-static coating on the tube. A dark, or neutral density, coating on an exterior surface of a CRT faceplate panel is a cost-effective alternative to a dark glass faceplate to achieve such a result. The incorporation of anti-glare, or glare-reducing, properties into a neutral density faceplate coating is well known in the art and is described, for example, in U.S. Pat. No. 3,898,509, issued to Brown et al. on Aug. 5, 1975. In that patent, a small quantity of India ink, containing carbon, is added to an aqueous lithium silicate solution to form a coating solution that is sprayed onto the exterior surface of a CRT faceplate panel to reduce the overall transmission of the faceplate from 69% (uncoated) to 42%, while providing glare-reduction. The effectiveness of the light transmission reduction is a function of the quantity of light-attenuating material in the coating composition. The small quantity of carbon utilized in U.S. Pat. No. 3,898,509 is insufficient to provide an anti-static property to the coating.

The term "anti-glare" or "glare reduction" as used herein, is the reduction in brightness and resolution of the reflected image of the ambient light source. Glare of light from ambient light sources interferes with the viewing of an image on the tube faceplate and is therefore objectionable to the viewer.

The incorporation of anti-static properties into a faceplate coating also is well known in the art and is described, for example, in U.S. Pat. No. 4,563,612, issued to Deal et al. on Jan. 7, 1986. The anti-static properties of a coating relate to the elapsed time required to discharge the electrostatic voltage on the coated faceplate. In U.S. Pat. No. 4,563,612, operative concentrations of an inorganic metallic compound are introduced into the coating composition for imparting the anti-static characteristics to the coating. A baking step, at a temperature of at least 120° C., and preferably in the range of 150° to 300° C., is required in order to develop the final electrical, optical and physical properties of the coating. That patent also states that some additive materials, such as carbon, are known to impart an anti-static characteristic to a silicate coating; however, such a large concentration of carbon must be added to achieve the anti-static characteristics that it degrades the image-transmitting characteristic of the tube to an unacceptable level. The concentration of carbon required to provide an anti-static characteristic is not given; however, U.S. Pat. No. 3,898,509, which utilizes 0.26 g. of carbon in a 173.5 ml coating solution (yielding a total carbon concentration of 0.15 wt. %), is not disclosed to have anti-static characteristics.

The problem to which the present invention is directed is to formulate an anti-glare, anti-static, dark coating, utilizing inexpensive materials, to provide a tube with an effective faceplate transmission of 40%, or less, while maintaining a gloss, within the range of 50 to 70. Gloss is a measure of the surface reflectivity of the faceplate panel at 600 from the vertical using a glossmeter. Gloss values range from 1 to 100, and indicate the percent of reflected light not scattered by the coating on the exterior surface of the faceplate panel.

SUMMARY OF THE PRESENT INVENTION

According to the present invention, a process of manufacturing a cathode-ray tube which includes a faceplate panel with an exterior surface having thereon an anti-glare, anti-static, dark coating is described. The process is characterized by the steps of: (a) forming a substantially homogeneous initial carbon dispersion containing substantially equal parts, by weight, of carbon particles and an organic vehicle; and (b) combining a sufficient quantity of the homogeneous initial carbon dispersion with an aqueous solution of lithium polysilicate to form a final dispersion suitable for application to the faceplate of the CRT.

BRIEF DESCRIPTION OF THE DRAWINGS

The invention will now be described in greater detail, with reference to the accompanying drawings in which.

DETAILED DESCRIPTION OF THE PREFERRED EMBODIMENT

Figure 1:
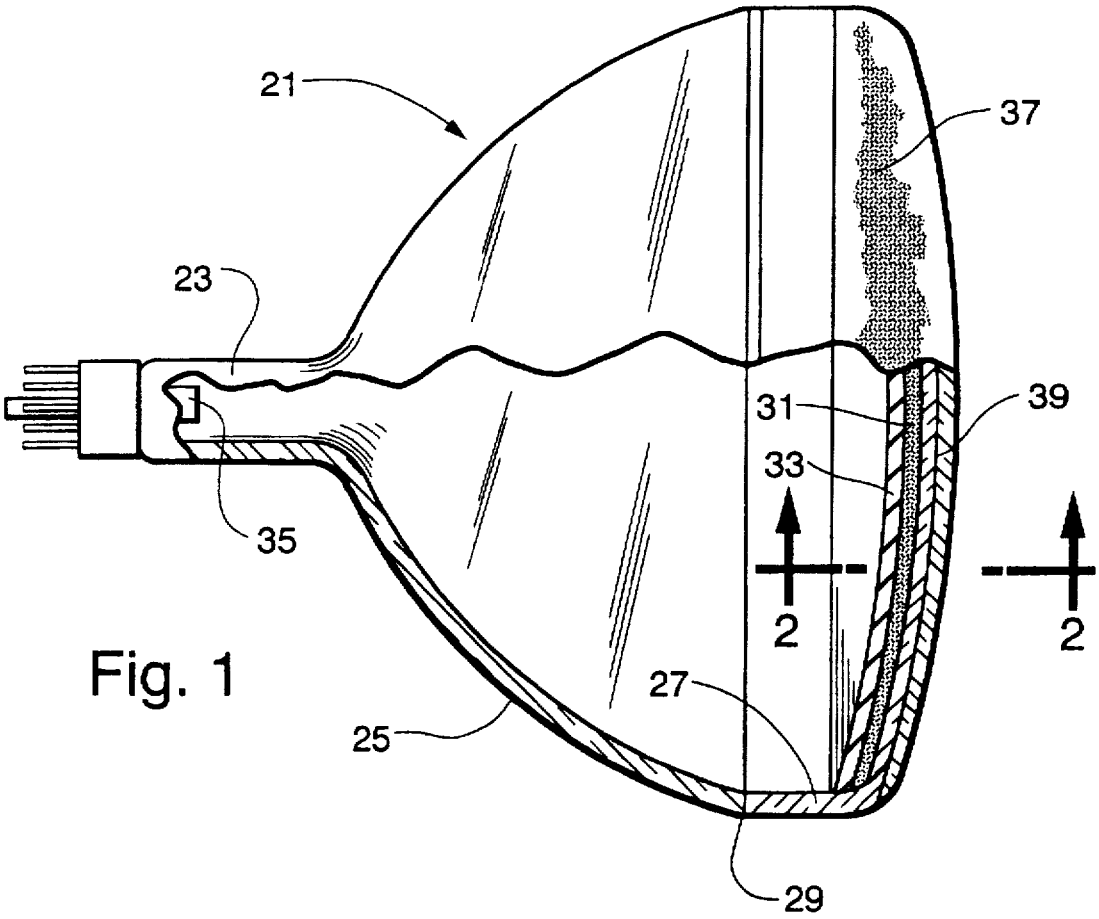
FIG. 1 is a partially broken-away longitudinal view of a CRT made according to the process of the present invention.
Figure 2:
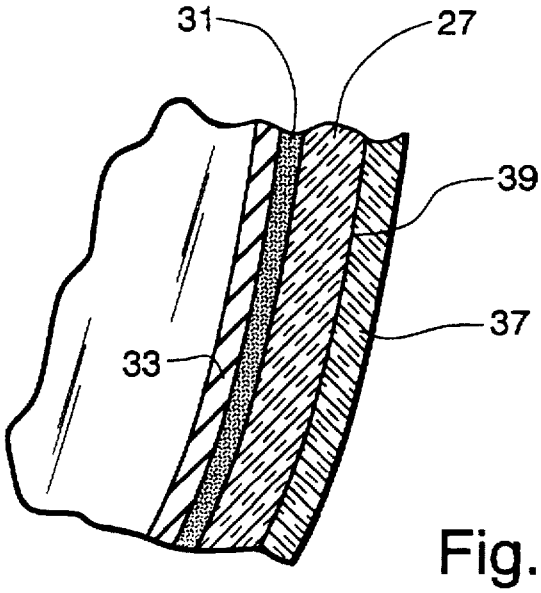
FIG. 2 is an enlarged sectional view through a fragment of the faceplate of the tube illustrated in FIG. 1, along section lines 2—2.

A cathode-ray tube 21, illustrated in FIG. 1, includes an evacuated glass envelope having a neck section 23 integral with a funnel section 25. A glass faceplate panel 27 is joined to the funnel section 25 by a devitrified glass frit seal 29. A luminescent screen 31 of phosphor materials is applied to an interior surface of the faceplate panel 27. A light-reflecting metal film 33 of, for example, aluminum, is deposited on the luminescent screen 31, as shown in detail in FIG. 2. The luminescent screen 31, when scanned by an electron beam from a gun 35, is capable of producing a luminescent image which may be viewed through the faceplate panel 27. A novel anti-glare, anti-static, dark coating 37 is applied to an exterior surface 39 of the faceplate panel 27, to prevent an electrostatic charge build-up, and improve the contrast of the image, when viewed through the panel 27.

The present novel anti-glare, anti-static, dark coating 37 is similar to the glare-reducing, dark, or neutral density, faceplate coating described in Italian patent application MI 93 A002036, filed on 23 Sep., 1993, and assigned to VIDEOCOLOR, S.p.A., but differs in that the novel coating also possesses anti-static properties, whereas the prior coating described in the Italian patent application does not.

Additionally, the present novel coating is formulated to have a more concentrated initial carbon dispersion that contains carbon and organic materials in a ratio within the range of 1:1 to 1.2:1, whereas the carbon-to-organic material ratio of the prior initial dispersion, or carbon slurry, is 3:1. The coating composition sprayed onto the faceplate to form the prior glare-reducing, neutral density coating contains between 5.5 wt. % of the carbon slurry (0.24 wt. % carbon) to 14.5 wt. % of the carbon slurry (0.64 wt. % carbon). Furthermore, the initial carbon dispersion of the novel coating is homogeneous so that, surprisingly, the novel coating made using the present initial carbon dispersion has anti-static properties that are superior to those of the prior coating, even though the carbon content of the prior final coating composition may, in some instances, equal or exceed that of the present final dispersion. The present final dispersion, prepared using the novel initial carbon dispersion, with a ratio of organic material- to-carbon of out 1:1, possesses the same homogeneity and carbon particle size, in the range of 0.2–0.3 μm, as does the initial carbon dispersion. It is believed that the maintenance of the small particle size in the final dispersion and in the faceplate coating is responsible for the anti-static properties of the present coating. By contrast, the prior coating with equal or higher carbon content, was found to have carbon particles that agglomerated in the final coating composition to a size of about 1.4 to 1.5 μm. This agglomeration of the carbon particles is believed to be responsible for the lack of anti-static properties in the prior coating.

The present coating is applied to an exterior surface 39 of the faceplate panel 27 of a sealed and evacuated tube 21 by carefully cleaning the surface 39 by any of the known scouring and washing methods used to remove dirt, lint, oil, scum, etc., that will not scratch the surface of the faceplate panel. It is preferred to scrub the surface with a commercial scouring compound, then rinse the surface with water. The surface is then etched, by swabbing it with a 2–8 wt. % ammonium biflouride solution, then rinsed with demineralized, i.e., deionized, water and dried using an air curtain to prevent water marks. The faceplate panel is then warmed to about 30°–80° C. in an oven, or by other suitable means, and coated with a final dispersion comprising lithium polysilicate, and a homogeneous initial carbon dispersion which includes equal parts, by weight, of carbon particles and organic materials, and further includes a base solution and a suitable quantity of colloidal silica to provide mechanical strength to the resultant faceplate coating. The lithium polysilicate is a lithium-stabilized silica sol in which the ratio of $SiO_2$ to $Li_2O$ is between about 4:1 to about 25:1. The sol is substantially free of anions other than hydroxyl. The lithium stabilized silica sol differs substantially from a lithium silicate solution, which is a compound dissolved in a solvent and not a sol. Upon subsequent heating, a lithium-sol coating dries to form a lithium silicate coating. The novel final dispersion may be applied in one or several layers by any conventional process, such as spraying. The coating is dried in air and then heated by raising its temperature by 15° to 60° C. above ambient temperature (about 22° C.). The coating is next washed for about 15–60seconds with warm water, which is at a temperature of 50°–60° C. The coating is carefully dried in air to avoid the deposition of lint or other foreign particles on the coating.

The novel coating has anti-static characteristics, that is, when grounded, the coating does not store electrostatic charge when the tube is operated in a normal manner. The novel coating also has an anti-glare, or glare-reducing, quality. That is, the coating scatters reflected light. Additionally, the carbon added to the coating to achieve the anti-static characteristic also darkens the coating to improve image contrast.

EXAMPLE 1

The exterior surface 39 of the faceplate panel 27 of an evacuated CRT 21 is cleaned by any of the known scouring and washing procedures and, then, lightly etched with a 5 wt. % ammonium bifluoride solution and rinsed in deionized water. Next, the faceplate panel 27 of the tube is heated within the range of 30° to 80° C., and a novel liquid coating composition or final dispersion is sprayed onto the warm glass surface. The final dispersion is prepared by first forming an initial carbon dispersion that comprises

- 6 wt. % of a surfactant, such as Brij 35 SP, available from ICI America Inc. Wilmington, Del., USA,
- 24 wt. % of a dispersant, such as Marasperse CBA-1 or CBOS-3, available from Ligno Tech., Greenwich, Conn., USA,
- 1.5 wt. % of a base solution, such as 30%, by weight, ammonium hydroxide,
- 36 wt. % carbon, such as BP-1300, available from Cabot Corp., Waltham, Mass., USA,
- 7.5 wt. % colloidal silica, such as Ludox, AM, to provide increased abrasion resistance, available from E. I. DuPont Co., Wilmington, Del., USA, and the balance demineralized (deionized) water.

The initial carbon dispersion is mixed using a model 15M homogenizer operated at 7030 kg $cm^{-2}$ (10,000 psi), available from Gaulin Corp. Everett, Mass., USA. The homogenizer makes it possible to mix the organic constituents, comprising the surfactant and the dispersant, and the carbon particles, having a particle size of 0.2 to 0.3 μm, in a carbon-to-organics ratio ranging from 1:1 to 1.2:1. Surprisingly, the homogeneous initial carbon dispersion retains the small particle size of the carbon particles within the range of 0.2 to 0.3 μm when a small quantity of the initial carbon dispersion is mixed with lithium silicate 48 and water to form the final dispersion. The carbon to organics ratio of the above described Italian patent application is 3:1, however, the prior coating does not have adequate anti-static characteristics, because the carbon particles agglomerate from an initial size of 0.2 to 0.3 μm, in the initial carbon slurry, to a size of 1.4 to 1.5 μm in the final coating composition.

The present final dispersion is formed by mixing 1.24 wt. % of the homogeneous initial carbon dispersion with 2.2 wt. % of (lithium) polysilicate 48, manufactured by E. I. DuPont Co., Wilmington, Del., USA, and the balance deionized water. This final dispersion, containing 0.45 wt. % carbon, is sprayed onto the faceplate panel to form a coating that provides a 27% reduction in the transmission of a faceplate panel, at 70 gloss.

EXAMPLE 2

Another final dispersion is formed by mixing 1 wt. % of the homogeneous initial carbon dispersion with 2.2 wt. % of (lithium) polysilicate 48 and the balance deionized water. This final dispersion, containing 0.36 wt. % carbon, is sprayed onto the faceplate panel to form a coating that provides a 19% reduction in the transmission of a faceplate panel, at 70 gloss.

The gloss values for the above formulations may be changed by either increasing or decreasing the quantity of the final dispersion sprayed onto the faceplate panel. For example, an increased quantity of the formulation described in Example 2 may be sprayed onto the panel to achieve a gloss of 56. The increase in quantity may be achieved either by providing a greater number of spraying passes, or by increasing the amount of the final dispersion in each spray pass.

Figure 3:
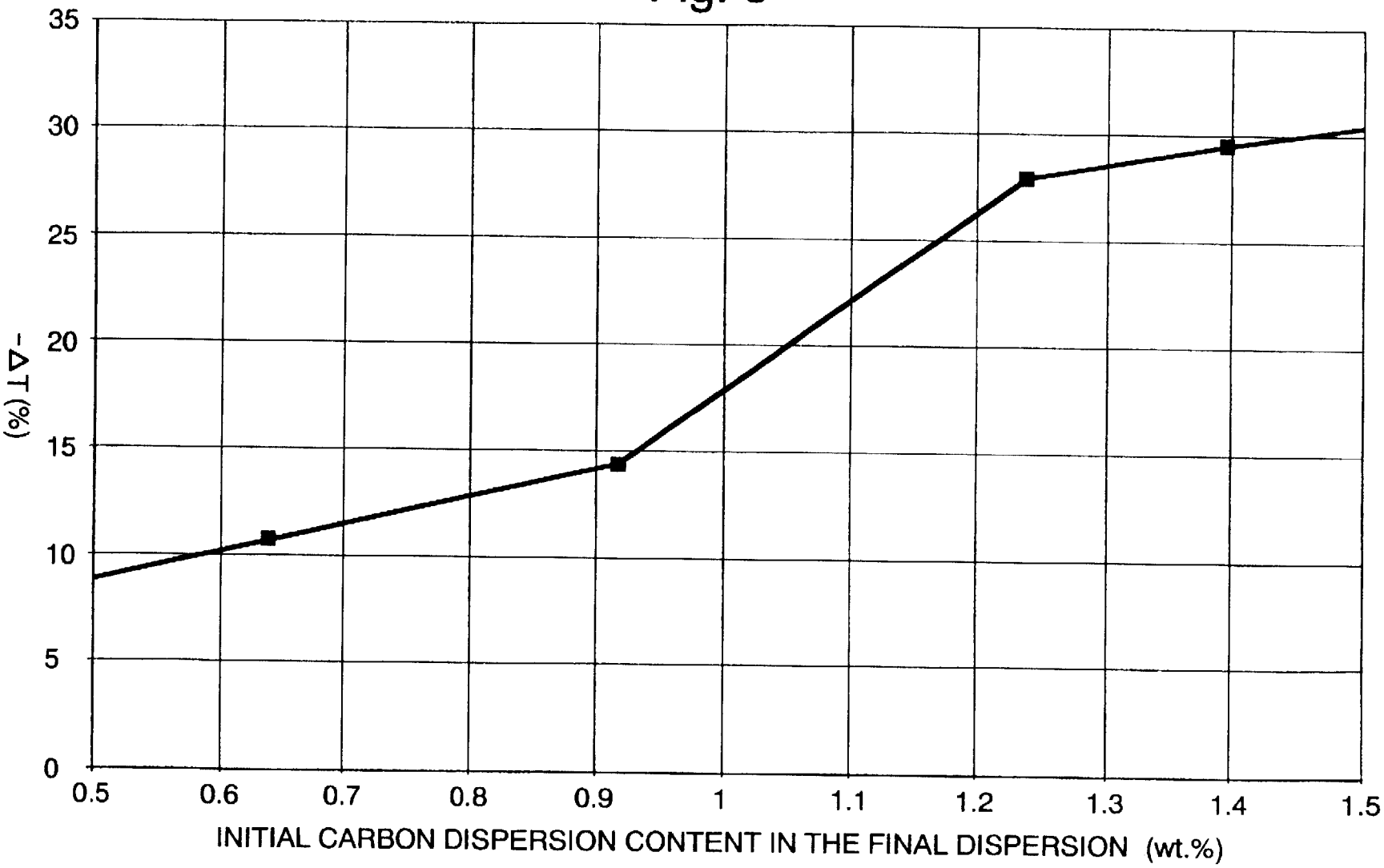
FIG. 3 is a graph showing the percent reduction in faceplate transmission as a function of the wt. % concentration of the homogeneous initial dispersion in the final dispersion of the novel coating.

FIG. 3 is a graph of the percent reduction in faceplate transmission, at 70 gloss, as a function of the concentration of the homogeneous initial carbon dispersion in the final coating composition, for initial dispersion concentrations ranging from 0.5 wt. % to 1.5 wt. %.

Figure 4:
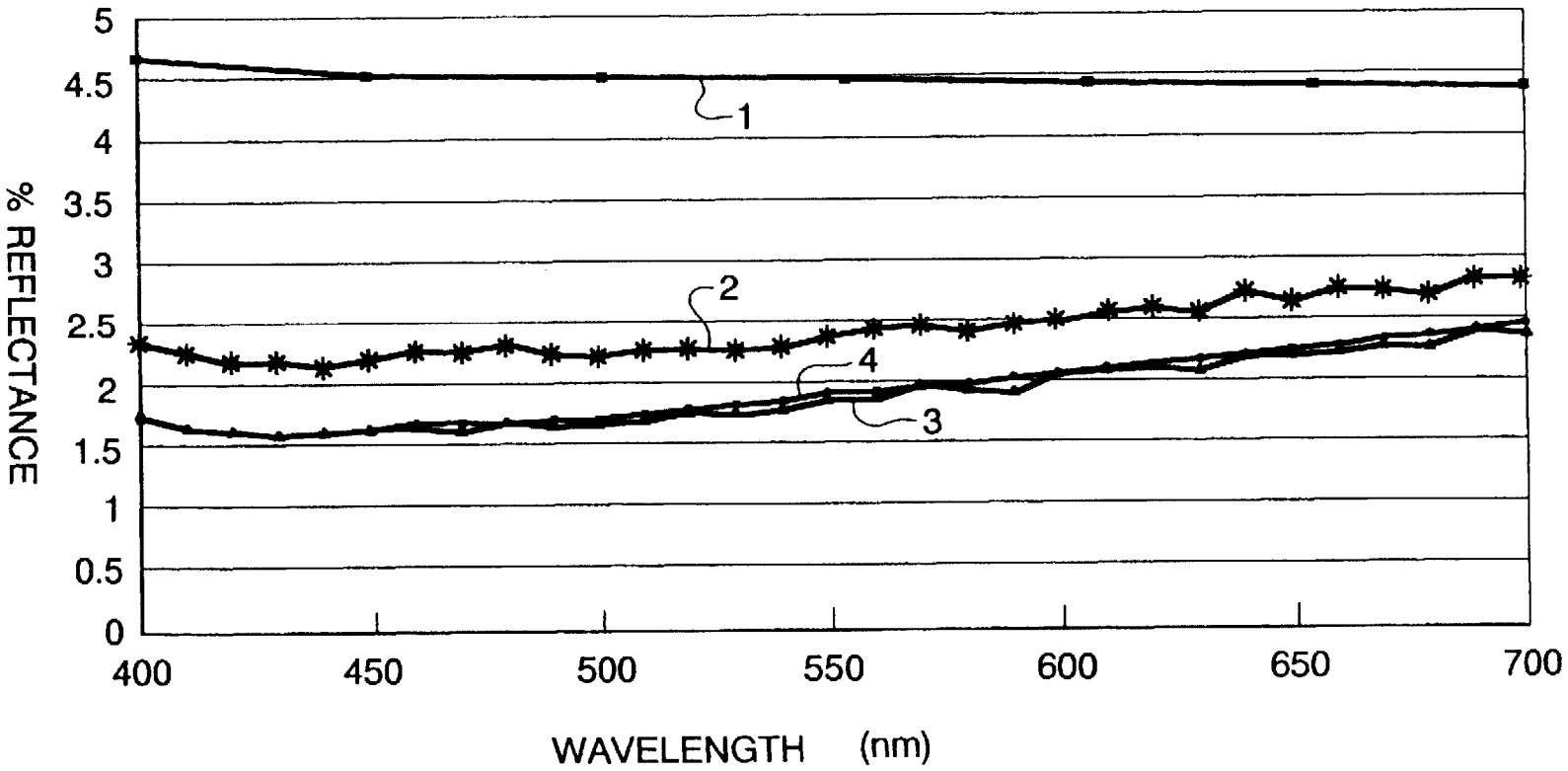
FIG. 4 is a graph of the percent spectral reflectance as a function of wavelength, for four faceplate panels, including an uncoated control (1), a prior coating composition (2), and two panels (3) and (4) made according to the present process, with different compositional levels of the homogeneous initial dispersion of the novel coating.

The spectral reflectances of coated and uncoated faceplate panels are shown in the family of curves presented in FIG. 4. Spectral reflectance is a measure of the surface reflectivity at an incident angle of 13.5°, using a gonioreflectometer. An uncoated faceplate panel, which represents a reference, is identified as Curve 1. A faceplate panel having an anti-glare, dark coating made according to the teaching of Italian patent application MI93A002036, with a carbon-to-organics ratio of 3:1, is identified as Curve 2. Curves 3 and 4 are made according to the present invention and have a carbon-to-organics ratio within the range of 1:1 to 1.2:1. Curves 3 and 4 differ from one another only in the concentration of the initial carbon dispersion in the final dispersion. In Curve 3, the concentration of the initial carbon dispersion is 0.5 wt. %, providing a final dispersion having 0.18 wt. % carbon; whereas, in Curve 4, the concentration of the initial carbon dispersion is 0.7 wt. % and the final dispersion has a carbon content of 0.25 wt. %. From FIG. 4, it can be seen that the present novel coatings of Curves 3 and 4 have lower spectral reflectance than the prior coating of Curve 2. From this it is concluded that the present homogeneous initial carbon dispersion, with its higher concentration of organics materials, provides superior spectral reflectance performance than the prior formulation with a lower concentration of organic materials.

Figure 5:
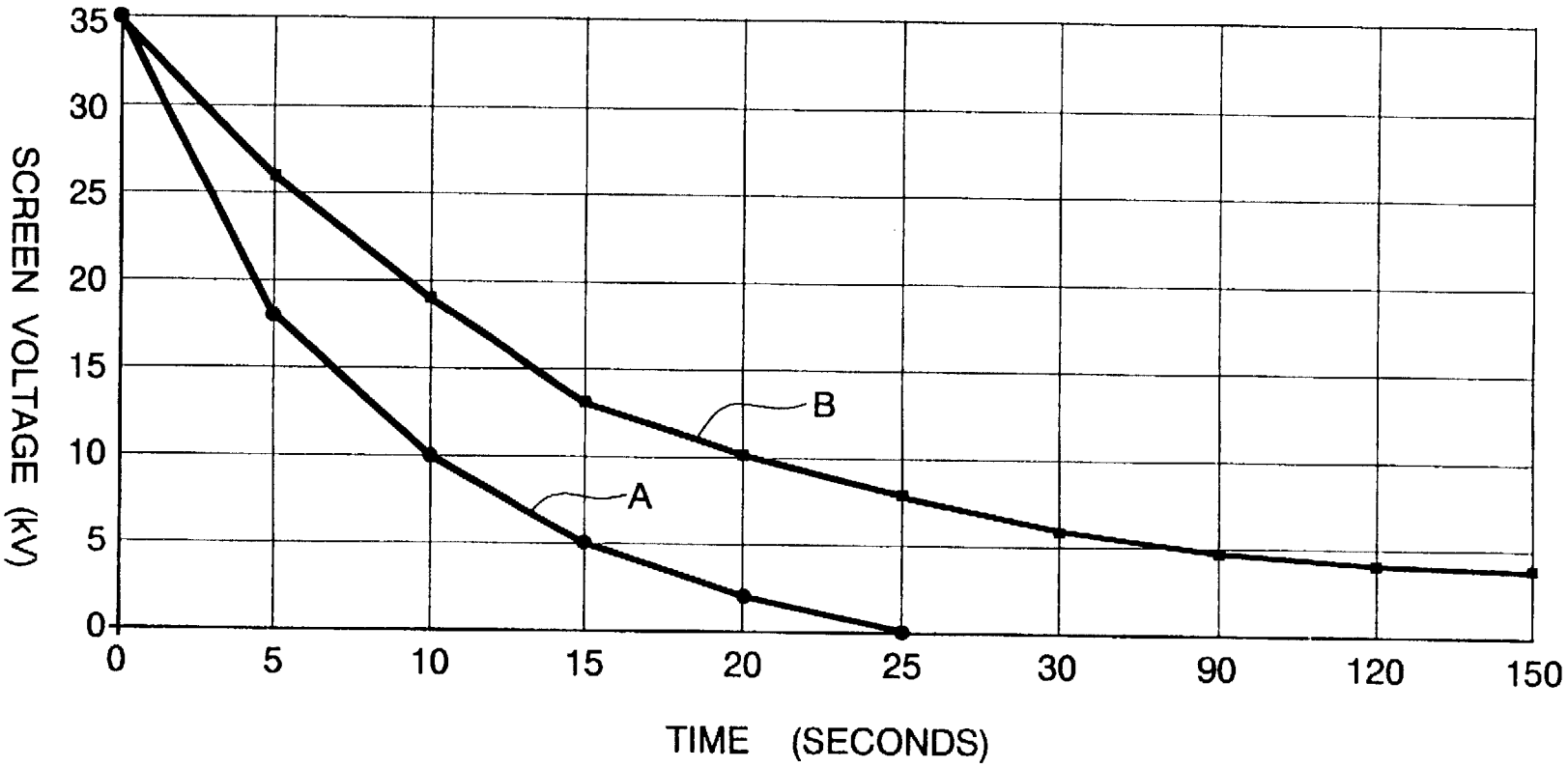
FIG. 5 is a graph of the anti-static properties of faceplate coatings showing voltage decay as a function of time for the present coating (A) and a prior coating (B).

The antistatic properties of the novel coatings have been quantified by the technique of measuring the elapsed discharge time as a function of the decrease in the screen voltage applied to the CRT. Initially, 30 kV is applied to the CRT. The novel coating, having a carbon-to-organics ration within the range of 1:1 to 1.2:1 in the initial homogeneous carbon dispersion, is capably of continuously discharging electrostatic voltages on the screen within the range of 25 to 32 kV in about 20 to 25 seconds. The electrical properties of the novel coating and the prior coating, the latter as described in the pending Italian patent application and having a carbon-to-organics ratio of 3:1, were measured using a SIMCO™ static decay meter, available from SIMCO, B.V. Lochem, Holland, at a temperature within the range of 20° to 25° C. and at 50 ±5% relative humidity. As shown in FIG. 5, with 30 kV applied to the tubes, the present novel coating, identified as Curve A, discharged completely within 25 seconds; whereas the prior coating, made according to the formulation of the Italian patent application, identified as Curve B, required 600 to 700 seconds to discharge (only the first 150 seconds of the discharge period are shown). The results of the anti-static test demonstrate that the present coating possesses good anti-static characteristics; however, the prior coating, having about the same carbon content, does not demonstrate anti-static performance. This surprising result is believed to be attributable to the initial carbon dispersion of the present coating which, it is believed, prevents agglomeration of the carbon particles in the final dispersion and in the resultant faceplate coating. The good anti-static performance of the present coating is optimized when the final dispersion is applied to provide a reduction in transmission of at least 25%, i.e., with an initial carbon dispersion concentration of about 1.17 wt. % (0.42 wt. % carbon). The present coating can be applied to achieve a reduction in faceplate transmission of as much as 40%, at 70 gloss, without adversely affecting the color coordinates of the phosphors. By lowering the gloss value to 50, the transmission of the faceplate could be reduced by about 55%. TABLES 1—3 show the optical properties and color coordinates for three faceplates coated according to the present invention. For this test, the two faceplates identified in TABLES 1 and 2 were coated to obtain a 70 gloss, and a third faceplate was coated to obtain a 56 gloss. Each of the CRT's was measured for Tube Face Reflectivity, or TFR, with a spectroradiometer which compares the reflectivity spectrum of the CRT under test with a calibration standard.

TABLE 1

| | | Uncoated | Coated | Δ % |
|---|---|---|---|---|
| Optical Properties | | | | |
| Glass Transmission | | 51.2 | 37.4 | −27 |
| Gloss | | | 70 | |
| TFR | | 0.121 | 0.07 | −42 |
| Color Coordinates | | | | |
| Red | x | 0.632 | 0.633 | |
| | y | 0.347 | 0.348 | |
| Green | x | 0.284 | 0.284 | |
| | y | 0.605 | 0.608 | |
| Blue | x | 0.149 | 0.149 | |
| | y | 0.071 | 0.072 | |

TABLE 2

| | | Uncoated | Coated | Δ % |
|---|---|---|---|---|
| Optical Properties | | | | |
| Glass Transmission | | 45.7 | 37 | −19 |
| Gloss | | | 70 | |
| TFR | | 0.093 | 0.061 | −34 |
| Color Coordinates | | | | |
| Red | x | 0.634 | 0.636 | |
| | y | 0.338 | 0.338 | |
| Green | x | 0.285 | 0.289 | |
| | y | 0.592 | 0.59 | |
| Blue | x | 0.152 | 0.151 | |
| | y | 0.063 | 0.064 | |

TABLE 3

| | | Uncoated | Coated | Δ % |
|---|---|---|---|---|
| Optical Properties | | | | |
| Glass Transmission | | 45.7 | 28.8 | −37 |
| Gloss | | | 56 | |
| TFR | | 0.097 | 0.054 | −44 |
| Color Coordinates | | | | |
| Red | x | 0.644 | 0.644 | |
| | y | 0.0337 | 0.336 | |
| Green | x | 0.291 | 0.296 | |
| | y | 0.603 | 0.604 | |
| Blue | x | 0.151 | 0.151 | |
| | y | 0.063 | 0.065 | |

While variations in the measured parameters among the three samples are evident from TABLES 1–3, the tests demonstrate that the novel coating formulation provides a significant reduction in glass transmission while maintaining the color fidelity of the CRT. The advantage of the present coating over purchasing expensive low transmission glass is that the coating need not be applied until the tube is manufactured and tested, thus saving money by only coating tubes that meet all of the manufacturing specifications. Additionally, TABLES 1 and 3 show that anti-static performance can be achieved at sufficiently low carbon levels, so that the image-transmitting characteristics of the CRT are not degraded

What is claimed is:

1. A process of manufacturing a cathode-ray tube (CRT) having an anti-glare, dark coating on an exterior surface of a CRT faceplate comprising the steps of:

forming a substantially homogeneous initial carbon dispersion containing substantially equal parts, by weight, of carbon particles and an organic vehicle;

combining between 0.6 to 1.4 wt. % of said homogeneous initial carbon dispersion with about 2.2 wt. % of lithium polysilicate and the balance deionized water to form a final dispersion comprising between 0.22 and 0.50 wt. % carbon and about 0.8 wt. % lithium polysilicate; and applying said final dispersion to said faceplate to form said anti-glare, dark coating.

2. The process as described in claim 1, wherein said initial carbon dispersion further comprises about 1.5 wt. % of a base solution, about 7.5 wt. % of colloidal silica, and deionized water.

3. The process as described in claim 1, wherein said organic vehicle consisting essentially of a dispersant and a surfactant.

4. The process as described in claim 3, wherein said weight ratio of said dispersant to said surfactant being about 4:1.

5. The process as described in claim 1, wherein the particle size of said carbon particles in said initial carbon dispersion and in said final dispersion being substantially equal.

6. The process as described in claims 5, wherein the particle size of said carbon particles in said initial carbon dispersion and in said final dispersion being within the range of 0.2 to 0.3 μm.

7. The process as described in claim 1, wherein said faceplate has a reduction in transmission of about 19 to 37%, and a gloss within the range of 56 to 70 after application of said final dispersion thereto.

* * * * *